United States Patent [19]

Miller, Jr.

[11] Patent Number: 4,694,981

[45] Date of Patent: Sep. 22, 1987

[54] HOLDER FOR SIDE-HANDLE BATON WITH ALLEN WRENCH

[76] Inventor: John C. Miller, Jr., 415 Claydon Way, Sacramento, Calif. 95864

[21] Appl. No.: 935,754

[22] Filed: Nov. 28, 1986

[51] Int. Cl.[4] ..... A45F 5/00

[52] U.S. Cl. ..... 224/251; 224/914

[58] Field of Search ..... 224/251, 914, 915, 253; 273/84 R

[56] References Cited

U.S. PATENT DOCUMENTS

| | | | |
|---|---|---|---|
| 3,307,754 | 3/1967 | Anketell | 224/251 X |
| 4,020,985 | 5/1977 | Halterman | 224/251 |
| 4,355,804 | 10/1982 | Bingham | 224/251 X |
| 4,424,923 | 1/1984 | Bingham | 224/251 |

*Primary Examiner*—Stephen Marcus
*Assistant Examiner*—Robert M. Petrik
*Attorney, Agent, or Firm*—W. Edward Johansen

[57] ABSTRACT

The present invention is a holder for carrying and detachably securing a side-handle baton on the belt of a policeman. The side-handle baton includes an elongated tubular club, a short side-handle and an allen-head screw. The side-handle is disposed perpendicular and rotatively coupled to the elongated tubular club by the allen-head screw which adjusts the rotational friction of the side-handle. The holder include a ring and a strap. The elongated tubular club of the side-handle baton is inserted into the ring. The strap is mechanically coupled to the ring and may be attached to the belt of the policeman. The holder also includes a post and an allen wrench. The post is disposed perpendicular and mechanically coupled to the ring. The post prevents the elongated tubular club from rotating within the ring so that the side-handle does remains relatively stationary. The allen wrench is fixedly coupled to the post. The allen-wrench adjusts the allen-head screw of the side-handle baton.

1 Claim, 4 Drawing Figures

HOLDER FOR SIDE-HANDLE BATON WITH ALLEN WRENCH

BACKGROUND OF THE INVENTION

1. Field of the Invention

The present invention relates to a holder for carrying and detachably securing a policeman's baton and more particularly a holder which also has an allen wrench for use in adjusting the handle of the policeman's baton.

2. Description of the Prior Art

U.S. Pat. No. 4,424,923, entitled Baton and Club Securing Device, issued to Dennis M. Bigham on Jan. 10, 1984, teaches a holder for detachably securing a baton in a carrying ring through which the baton may be slideably inserted. The holder includes a base by which the holder is attached to the baton. The base is in the form of a ring into which the baton is inserted. The base also includes an enlarged portion which contacts the ring when the baton is inserted through the ring in order to support the base and the baton so that the baton is prevented from sliding downwardly all the way through the ring. The holder further includes a lever, the lower end of which is formed into a hook and the upper end of which serves as a trigger. The lever is fixed to the base so that the hook is normally biased to a first position where the hook will engage the ring and prevent removal of the baton from the ring when the baton is lifted. When the trigger is depressed, the hook is moved to a second position where the hook will not engage the ring when the baton is lifted.

U.S. Pat. No. 4,020,985, entitled Equipment Holder, issued to Kenneth Lowder Halterman on May 3, 1977, teaches an equipment holder for police security office that will mount on a belt and that will alternately carry a policeman's baton or a large heavy duty flashlight in such a manner that they are readily accessible and may be removed without warning any noise. The holder includes a strap with a belt loop which is formed in one end thereof and a small ring at the other end. A larger ring is concentricaly mounted around the small ring and a substantially rigid space is positioned between the rings and their pivot connection with the strap.

U.S. Pat. No. 4,355,804, entitled Baton and Club Securing Device, issued to D. Michael Bigham on Oct. 26, 1982, teaches a club that may be detachable secured to a carrying ring which includes an elongated stick that may be inserted through the carrying ring. A protruding shoulder member on the stick will not pass through the ring. The shoulder member provides a suspension point from which the stick may be suspended by the carrying ring. A locking device detachably secures the stick to the carrying ring in order to prevent the stick from being pulled or sliding out of the carrying ring unless a release mechanism is manually triggered or maintained. The night stick holder includes a flexible sleeve which is split substantially lengthwise and has a pair of axially spaced snap fasteners. The night stick has an enlarged diameter portion at the botton of the handle and the fasteners, when secured, serve to close the sleeve about the tapered body of the night stick the enlarged diameter portion and the tapered body serving to preclude endwise movement of the stick through the sleeve in either direction. To draw the stick from the holder, the stick is first canted forwardly and the upper fastener unsnapped. The stick may then be jerked downwardly and forewardly in a swinging motion to automatically unsnap the lower fastener whereby the stick is withdrawn through the split sleeve.

U.S. Pat. No. 3,997,053, entitled a tool holder for removably holding a plurality of tools such as hexagonal key wrenches in which the holder has a passage for each tool and in which each passage has, spaced from the end in which the tool is inserted, an inwardly extending projection which allows the tool to pass when a flat side of the tool is parallel to the flat face of the projection but which grips the tool when it is turned to bring a corner edge of the tool into engagement with the flat face to clamp it. With large tools, there are two opposed inwardly extending projections, one of which has groove into which a corner edge of the tool enters to yieldable retain the tool against rotation from its gripped position. With small tools, the toolholder has a shoulder against which the tool bears in order to limit the movement of the tool away from its gripped position. Instead of all of the passages being in a row, there are two overlying rows of passages so that the holder is narrower and thicker with the result that it can be conveniently grasped as a handle for one of the tool when that tool is partially withdrawn form the holder.

U.S. Pat. No. 4,479,171, entitled Side Arm Baton and Flashlight, issued to Gregg B. Mains on Oct. 23, 1984, teaches a combination of a side-handle baton and flashlight which includes an elongated tubular club and a short side-handle which is disposed at right angles and which is mechanically coupled to the elongated tubular club. The combination of a side-handle baton and flashlight also includes a flashlight assembly which is mechanically coupled to the elongated tubular club.

SUMMARY OF THE INVENTION

In view of the foregoing factors and conditions which are characteristic of the prior art it is the primary object of the present invention to provide a holder for carrying and detachably securing a policeman's baton which has an allen wrench for use in adjusting the handle of the policeman's baton.

In accordance with the preferred embodiment of the present invention a holder for carrying and detachably securing a side-handle baton on the belt of a policeman is described. The side-handle baton includes an elongated tubular club, a short side-handle and an allen-head screw. The side-handle is disposed perpendicular and rotatively coupled to the elongated tubular club by the allen-head screw which adjusts the rotational friction of the side-handle. The holder include a ring and a strap. The elongated tubular club of the side-handle baton is inserted into the ring. The strap is mechanically coupled to the ring and may be attached the belt of the policeman. The holder also includes a post and an allen wrench. The post is disposed perpendicular and mechanically coupled to the ring. The post prevents the elongated tubular club from rotating within the ring so that the side-handle does remains relatively stationary. The allen wrench is fixedly coupled to the post. The allen-wrench adjusts the allen-head screw of the side-handle baton.

The features of the present invention which are believed to be novel are set forth with particularity in the appended claims.

Other claims and many of the attendant advantages will be more readily appreciated as the same becomes better understood by reference to the following detailed description and considered in connection with the accompanying drawing in which like reference symbols designate like parts throughout the figures.

DESCRIPTION OF THE DRAWING

FIG. 1.

DESCRIPTION OF THE PREFERRED EMBODIMENT

Figure 1:
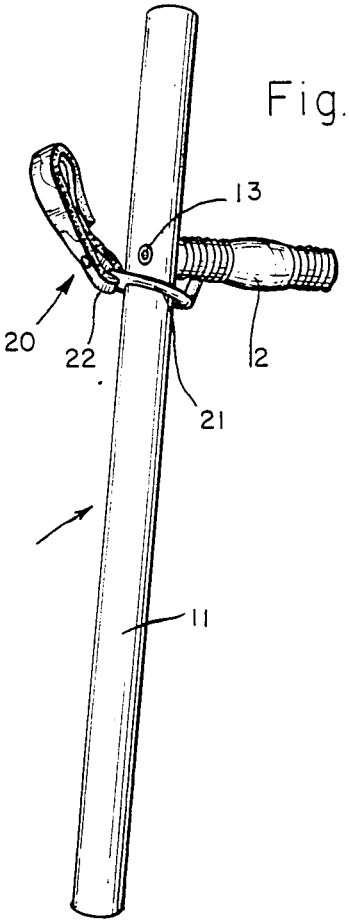
FIG. 1 is a perspective drawing of a holder for carrying and detachably securing a side-handle baton which has an allen wrench for use in adjusting the side-handle of the side-handle baton and which has been constructed in accordance with the principles of the preferred embodiment of the present invention.

In order to best understand the present invention it is necessary to refer to the following description of its preferred embodiment in conjunction with the accompanying drawing. Referring to FIG. 1 a side-handle baton 10 includes an elongated tubular club 11, a short side-handle 12 and an allen-head screw 13. The side-handle 12 is disposed perpendicular and rotatively coupled to the elongated tubular club 11 by the allen-head screw 13 which adjusts the rotational friction of the side-handle 12. A holder 20 for carrying and detachably securing the side-handle baton 10 includes a ring 21 and a strap 22. The elongated tubular club 11 of the side-handle baton 10 is inserted into the ring 21. The strap 22 is mechanically coupled to the ring. The strap 22 may be attached to the belt of the policeman.

Figure 2:
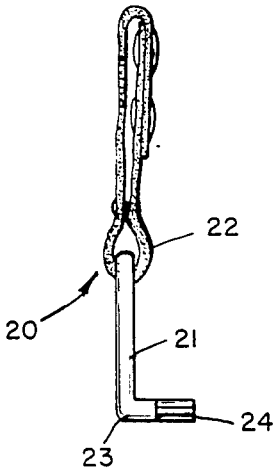
FIG. 2 is a side elevational view of the holder of FIG. 1.
Figure 3:
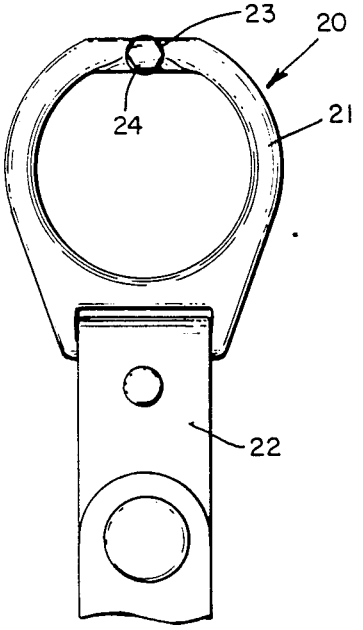
FIG. 3 is a top plan view of the holder of FIG. 1.

Referring to FIG. 1 in conjunction with FIG. 2 and FIG. 3 the holder 20 also includes a post 23 and an allen wrench 24. The post 23 is disposed perpendicular and mechanically coupled to the ring 21. The post 23 prevents the elongated tubular club 11 of the side-handle baton 10 from rotating within the ring 21 so that the side-handle 12 remains relatively stationary. The allen wrench 24 is fixedly coupled to the post 23.

Figure 4:
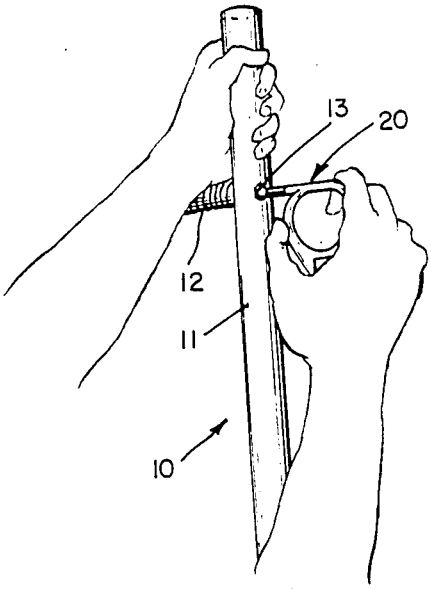
FIG. 4 is a schematic drawing of the holder being used to adjust the rotational friction.

Referring to FIG. 1 in conjunction with FIG. 4 the allen-wrench 24 adjusts the allen-head screw 13 of the side-handle baton 10. The rationale for modification of the holder 20 by placing the allen wrench 24 on the post 23 is to facilitate practical use of the side-handle baton 10. Prior to incorporating the allen wrench 24 on the post 23 anyone who employed the use of the side-handle baton 10 was required to use a separate small allen wrench in order to adjust the rotational friction of the side-handle 12 by inserting the small allen wrench into the allen head screw 13. The small allen wrench was easily either lost or misplaced. By placing the allen wrench 24 on the post 23 of the holder 20 anyone who employs the side-handle baton 10 will be able to easily locate and quickly deploy the allen wrench 24.

From the foregoing it can be seen that a holder for carrying and detachably securing a side-handle baton which has an allen wrench for use in adjusting the rotational friction of the side-handle baton has been described. It should be noted that distances of and between the figures are not to be considered significant.

Accordingly it is intended that the foregoing disclosure and showing made in the drawing shall be considered only as an illustration of the principles of the present invention.

What is claimed is:

1. A holder for carrying and detachably securing on the belt of a policeman a side-handle baton including an elongated tubular club and a short side-handle which is disposed perpendicular and rotatively coupled to the elongated tubular club with a screw for adjusting the rotational friction of the side-handle, said holder comprising:

a. a ring into which the elongated tubular club is inserted;

b. a strap which is mechanically coupled to said ring and which may be attached to the belt of the policeman;

c. a post which is disposed perpendicular and mechanically coupled to said ring and which prevents the elongated tubular club from rotating wlthin said ring so that the side-handle remains relatively stationary;

d. screw adjusting means for adjusting the screw of the side-handle baton, said screw adjusting means being fixedly coupled to said post.

* * * * *